US008837680B2

(12) United States Patent
Tsujii et al.

(10) Patent No.: US 8,837,680 B2
(45) Date of Patent: Sep. 16, 2014

(54) RADIATION TRANSMISSION TYPE TARGET

(75) Inventors: Osamu Tsujii, Kawasaki (JP); Noriaki Oguri, Zama (JP); Takashi Ogura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 330 days.

(21) Appl. No.: 13/469,792

(22) Filed: May 11, 2012

(65) Prior Publication Data

US 2012/0314837 A1 Dec. 13, 2012

(30) Foreign Application Priority Data

Jun. 10, 2011 (JP) ..... 2011-129843

(51) Int. Cl.
*H01J 35/08* (2006.01)
*H01J 35/18* (2006.01)

(52) U.S. Cl.
CPC ..... *H01J 35/18* (2013.01); *H01J 2235/081* (2013.01); *H01J 2235/183* (2013.01); *H01J 2235/087* (2013.01); *H01J 35/08* (2013.01)
USPC ..... 378/143; 378/140

(58) Field of Classification Search
CPC ... H01J 35/08; H01J 35/108; H01J 2235/081; H01J 35/10; H01J 2235/088; H01J 2235/18; H01J 2235/183; H01J 35/16; H01J 35/18
USPC ..... 378/140, 143, 144
See application file for complete search history.

(56) References Cited

U.S. PATENT DOCUMENTS

2013/0259205 A1* 10/2013 Kraft et al. ..... 378/131

FOREIGN PATENT DOCUMENTS

JP 2002-352754 A 12/2002

* cited by examiner

*Primary Examiner* — Courtney Thomas
(74) *Attorney, Agent, or Firm* — Fitzpatrick, Cella, Harper & Scinto

(57) ABSTRACT

A radiation transmission type target to be used for a radiation tube has a target metal 12 placed on a substrate 13, and has an antistatic member 14 placed on a surface of the substrate 13 opposite to a surface on which the target metal 12 is placed. The target suppresses its electrostatic charge, and enables the radiation tube to stable operate.

6 Claims, 2 Drawing Sheets

RADIATION TRANSMISSION TYPE TARGET

BACKGROUND OF THE INVENTION

1. Field of the Invention

The present invention relates to a radiation transmission type target, a transmission type radiation tube using the target, and a radiation imaging apparatus using the radiation tube.

2. Description of the Related Art

A transmission type X-ray tube is a vacuum tube which includes an anode, a cathode and an insulating tube, accelerates electrons to be emitted from an electron emission source of the cathode with a high voltage applied between the anode and the cathode, and irradiates a metal target provided on the anode with the accelerated electrons to make the metal target generate X-rays. The transmission type X-ray tube is adopted in an X-ray generating apparatus for medical use or industrial use.

Such a general transmission type X-ray tube accelerates and converges an electron beam which has been emitted from a filament of the cathode, and makes the accelerated and converged electron beam collide with the target metal provided on a substrate in an X-ray transmission window on the anode side to make the target metal generate X-rays in a transmitting direction. In the structure of the transmission type X-ray target which generates the X-rays, an insulator of a ceramic or glass with high heat-resistance is used for the substrate in the X-ray transmission window, which has the target metal vapor-deposited on the inner surface. In addition, as a material of the target metal, a metal, which is a high melting point metal and is a heavy metal, is selected. In addition, in such an X-ray tube, the electron beam which has been accelerated by the high voltage collides with the target, the periphery of an insulating portion is electrostatically charged with the electrons and reflected electrons, which are eventually discharged to destroy the target structure and lower the withstand voltage, and consequently a stable operation has been impaired.

As for a countermeasure for preventing the electrostatic charge in order to solve these various problems caused by the influence of the electrostatic charge, a target structure having an antistatic film imparted therein is described in Japanese Patent Application Laid-Open No. 2002-352754. It is specifically disclosed that an X-ray target of a transmission type employs an insulator such as a ceramic or glass for a substrate in the X-ray transmission window, has an antistatic film made from a metal other than the target metal formed on the inner surface thereof, and has the target metal vapor-deposited thereon. Japanese Patent Application Laid-Open No. 2002-352754 describes that the X-ray target can stably operate because of having the antistatic film provided therein so that the periphery of the insulator is not charged with the electrons which have collided with the target.

However, a conventional X-ray tube has the following problems in the prevention of the electrostatic charge. In other words, the antistatic film can prevent the inner surface of the substrate in the X-ray transmission window from being electrostatically charged, because the substrate in the X-ray transmission window has the antistatic film made from the metal other than the target metal formed on its inner surface, and the target metal is vapor-deposited on the antistatic film. However, on the outer surface of the substrate, in other words, on a surface opposite to a surface on which the target material in the X-ray transmission window is formed, the insulating surface of the ceramic or the glass is exposed which is the substrate in the X-ray transmission window. Because of this, electrons which have collided with the target substrate or positive ions which have been ionized due to the emitted electrons are deposited on the target substrate, and cause an electrostatic charge. As a result, the conventional X-ray tube has had such problems that a rise in an electric potential due to the electrostatic charge causes electric discharge, and the electrostatic charge of the target substrate hinders a stable operation.

An object of the present invention is to provide a radiation tube which solves the above described problems, achieves the prevention of the electrostatic charge and can stably operate.

SUMMARY OF THE INVENTION

According to one aspect of the present invention, a radiation transmission type target having a target metal placed on a substrate comprises: an antistatic member placed on a surface of the substrate opposite to a surface on which the target metal is placed.

According to the present invention, a surface opposite to a surface of a substrate on which a target metal is placed can be effectively prevented from being electrostatically charged, and the stable operation of a radiation tube can be secured.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Exemplary embodiments of a radiation transmission type target and a transmission type radiation tube using the same according to the present invention will be described below with reference to the drawings, while taking an X-ray tube as an example. However, the materials, dimensions, shapes, relative arrangements and the like of components which are described in the following embodiments do not limit the scope of the present invention only to those, unless otherwise specified.

Figure 1A:
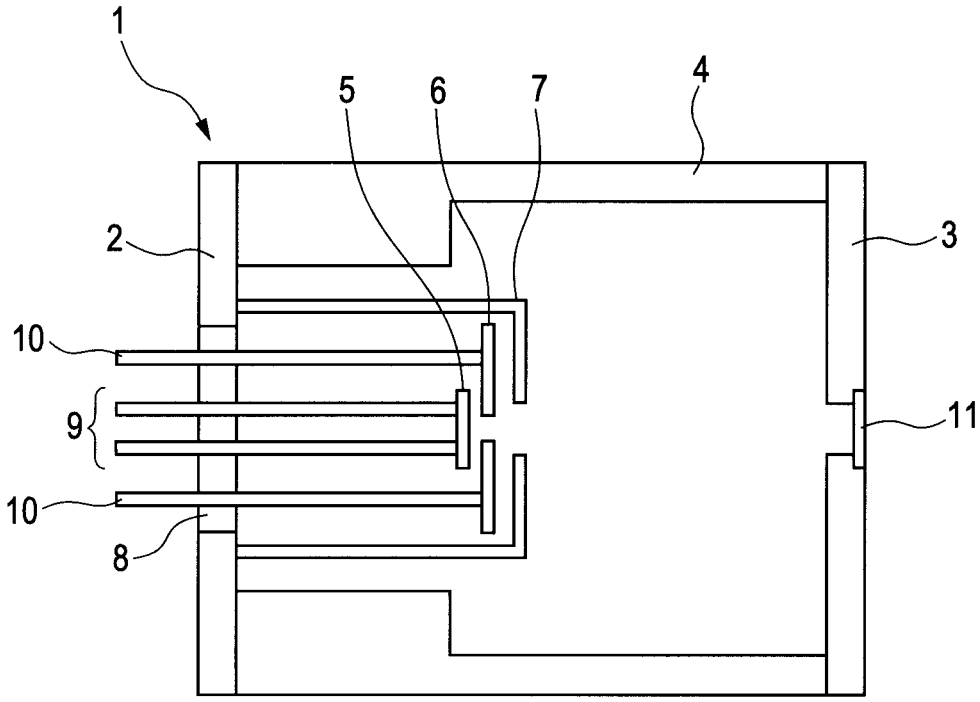
FIGS. 1A and 1B are block diagrams of an X-ray tube according to the present invention.
Figure 1B:
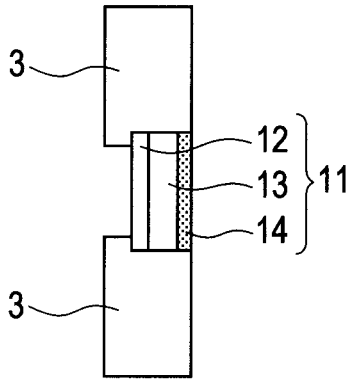

FIGS. 1A and 1B are block diagrams of an X-ray tube of the present embodiment; FIG. 1A is a schematic sectional view of the X-ray tube of the present embodiment taken along a plane including a cathode, an anode, an insulating tube, an electron source and a target; and FIG. 1B is an enlarged view of the peripheral portion of the target of FIG. 1A.

An X-ray tube 1 is a vacuum tube which includes; an envelope including a cylindrical insulating tube 4, a cathode 2 arranged at one side of the cylindrical insulating tube 4, and an anode 3 arranged on the other side of the cylindrical insulating tube 4, wherein an inside of the envelope is hermetically sealed; an electron source 5 arranged within the envelope, and a target 11 arranged on the anode 3.

The electron source 5 is an electrode which emits electrons. The electron source 5 can employ any of a cold cathode and a hot cathode as an electron-emitting element, but the electron source 5 to be applied to the X-ray tube 1 of the present embodiment can employ an impregnated cathode (hot cathode) which can stably take out a large electric current. The impregnated cathode raises a temperature of the cathode by energizing a heater in the vicinity of an electron-emitting portion (emitter), and emits electrons.

A grid electrode 6 is an electrode to which a predetermined voltage is applied in order to draw the electrons emitted from the electron source 5 to the vacuum, and is arranged so as to be separated from the electron source 5 by a predetermined distance. The shape, the opening size, the aperture ratio and the like of the grid electrode 6 are determined in consideration of the drawing efficiency of an electron beam and the exhaust conductance in the vicinity of the cathode. Usually, a tungsten mesh having a wire diameter of approximately 50 μm can be used.

A focusing electrode 7 is an electrode for controlling a spread (beam diameter) of an electron beam which has been drawn by the grid electrode 6. Usually, a voltage of several hundreds V to several kV is applied to the focusing electrode 7, and thereby the focusing electrode 7 controls the beam diameter. It is also possible to omit the focusing electrode 7 and converge the electron beam only by a lens effect due to an electric field, though depending on the structure in the vicinity of the electron source 5 or the applied voltage.

The cathode 2 has an insulating member 8. A terminal 9 for driving the electron source and a terminal for the grid electrode are fixed to the insulating member 8 so as to be electrically insulated from the cathode 2. The terminal 9 for driving the electron source and the terminal 10 for the grid electrode are respectively drawn from the electron source 5 and the grid electrode 6 in the X-ray tube 1, to the outside of the X-ray tube 1. The focusing electrode 7 is fixed to the cathode 2, and is regulated so as to have the same potential as that of the cathode 2. However, the focusing electrode 7 may also be insulated from the cathode 2, and another potential may be given to the focusing electrode 7.

The anode 3 is electrically connected to the target 11. When the target 11 is joined to the anode 3, the target 11 can be soldered or welded to the anode 3 in view of the circumstance that the vacuum has to be kept, in addition to thermal bonding. A voltage of 10 kV to 100 kV is usually applied to the anode 3. The electron beam which has been generated by the electron source 5, has been drawn by the grid electrode 6 and has a predetermined amount of energy is directed to the target 11 on the anode 3 by the focusing electrode 7, is accelerated by a voltage applied to the anode 3, and collides with the target 11. X-rays are generated from the target 11 by the collision of the electron beam to the target, and are radiated in all directions. The X-rays which have transmitted through the target 11 out of the X-rays that have been radiated in all directions are taken out to the outside of the X-ray tube 1.

The target 11 has a target metal 12 which generates the X-rays by the collision of the electron beam, on a surface to be irradiated with the electron beam (surface opposing to electron source) of a substrate 13 which transmits the X-rays therein, as illustrated in FIG. 1B. The target 11 also has an antistatic member 14 which has a potential-regulating structure, on a surface opposite to the surface of the substrate 13, which is irradiated with the electrons.

The target metal 12 can usually employ a thin film made from a metal having an atomic number of 26 or more. A thin film which can be used is specifically made from tungsten, molybdenum, chromium, copper, cobalt, iron, rhodium, rhenium, tantalum, platinum, or alloy material of them. Among them, the thin film can be further used which is made from tungsten, tantalum, platinum, or alloy containing them and rhenium. As for the target metal 12, a dense film having a composition of high purity and strong adhesion can be obtained with a thermal CVD method using a chemical reaction at high temperature. A dense film structure can also be formed with a physical film-forming method such as a sputtering method, by selecting sputtering conditions. The optimal values of the thickness of the target metal 12 vary depending on an accelerating voltage because an penetration depth of the electron beam, in other words, a region in which the X-rays are generated, varies depending on the accelerating voltage, but when an accelerating voltage of approximately 100 kV is applied to the anode, the thickness is usually 1 μm to 10 μm.

The substrate 13 needs to have high transmittivity for X-rays and high thermal conductivity, and withstand vacuum sealing; and can employ carbon such as diamond, silicon carbide, aluminum carbide and graphite or carbon compound, silicon nitride, aluminum nitride, beryllium or the like, as its material. Diamond, aluminum nitride and silicon nitride can be further used, which have lower transmittivity for the X-rays than aluminum and higher thermal conductivity than tungsten. In particular, diamond is more excellent because of having extremely higher thermal conductivity than that of other materials, having also high transmittivity for the X-rays, and easily keeping the vacuum. The thickness of the substrate 13 may satisfy the above described functions, and can be 0.1 mm or more and 2 mm or less, though the thickness varies depending on the material.

Figure 2:
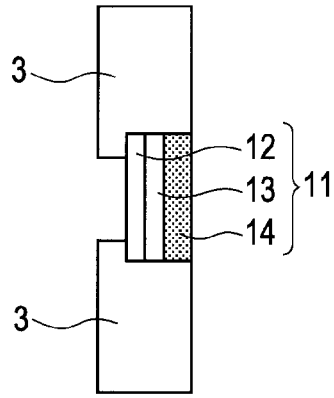
FIG. 2 is an enlarged view of a target portion in another X-ray tube according to the present invention.

The antistatic member 14 may be made from a conductive metal having high transmittivity for X-rays, and can be a high melting point metal excellent in heat resistance. Specifically, the usable materials are tungsten, molybdenum, chromium, copper, cobalt, iron, rhodium, rhenium, hafnium, tantalum, osmium, iridium, platinum, gold, titanium, lead, bismuth or alloy material of them. Further usable materials can be hafnium, tantalum, tungsten, rhenium, osmium, iridium, platinum, gold, titanium, lead, bismuth or alloy of them. In addition, the same metal as the target metal 12 can be used. The antistatic member 14 may be an antistatic film which has been formed, for instance, with a physical film-forming method or the like such as a thermal CVD method and a sputtering method, as is illustrated in FIG. 1A, or may also be an antistatic layer which has been formed, for instance, by sticking a metal plate to the substrate, as is illustrated in FIG. 2. The thickness of the antistatic member is not limited in particular, but can be 0.05 μm or more and 30 μm or less.

The insulating tube 4 is a tube which is formed of an insulating member such as glass and ceramic and has insulating properties, and has a cylindrical shape. The shape does not have many restrictions, but can be a cylindrical shape from the viewpoint of size reduction and easy production. The shape may be a square pillar shape. Both ends of the insulating tube 4 are each bonded to the cathode 2 and the anode 3 with a soldering technique or a welding technique. When air is exhausted with heating from the X-ray tube 1 in order to enhance the vacuum degree in the tube, the cathode 2, the anode 3, the insulating tube 4 and the insulating member 8 may employ materials which have close coefficients of thermal expansion to each other. The cathode 2 and the anode 3 may employ, for instance, kovar or tungsten; and the insulating tube 4 and the insulating member 8 may employ borosilicate glass or alumina.

Next, a radiation imaging apparatus according to the present invention will be described below. The radiation imaging apparatus according to the present invention includes a radiation generating apparatus provided with a transmission type radiation tube, and a radiation detector which detects the radiation that has been emitted from the radiation generating apparatus and has passed through an object. An example of an X-ray imaging apparatus using the X-ray tube in FIGS. 1A and 1B will be described below with reference to FIG. 3.

X-rays which have been radiated from an X-ray generating apparatus 30 are detected by an X-ray detector 31 through an object 35, and an X-ray transmission image of the object 35 is obtained. The X-ray detector 31 is connected to a controller 33 through a signal processing unit 32. A display 34 and a voltage controlling unit 29 are also connected to the controller 33. The controller 33 generally controls processing in the X-ray imaging apparatus. The controller 33 controls, for instance, an X-ray imaging operation of the X-ray generating apparatus 30 and the X-ray detector 31. The controller 33 also controls, for instance, the driving of the X-ray generating apparatus 30, and a voltage signal applied to the X-ray tube 28 through the voltage controlling unit 29. The taken X-ray transmission image is displayed on the display 34.

As has been described above, according to the X-ray tube of the present embodiment, an electron beam which has been generated by an electron source 5 passes through a target metal 12, a substrate 13 and an antistatic member 14, and the X-ray tube can stably operate without electrostatically charging the target. Furthermore, the X-rays which have been generated in the target metal 12 pass through the substrate 13 and the antistatic member 14, are radiated to the outside, and are detected by the X-ray detector 31 through the object 35. The obtained image can show a clear X-ray image with contrast.

Example 1

A block diagram of an X-ray tube of the present example is illustrated in FIGS. 1A and 1B. The description about the structure of the X-ray tube in FIGS. 1A and 1B is omitted because the structure has been described above.

Kovar was used for a cathode 2 and an anode 3, and alumina was used for an insulating tube 4 and an insulating member 8. The electrodes, the tube and the member were joined to each other by welding. The insulating tube 4 had a cylindrical shape. An impregnated cathode made by Tokyo Cathode Laboratory Co., Ltd. was used for an electron source 5. This impregnated cathode has an electron-emitting portion (emitter) impregnated therein, has a cylindrical shape, and is fixed to the upper end of a cylindrical sleeve. A heater is mounted in the sleeve, and the cathode is heated by the heater which has been energized through a terminal 9 for driving the electron source to emit electrons. The terminal 9 for driving the electron source was soldered to the insulating member 8.

The target 11 includes a substrate 13 which is made from silicon carbide and has a plate thickness of 0.5 mm, and a tungsten film with a film thickness of 5 μm formed thereon as a target metal 12. The target 11 also includes a tungsten film that has a film thickness of 0.1 μm, and is formed on a surface opposite to a surface on which the target metal 12 is placed, as an antistatic member 14. The target 11 was soldered to the anode 3.

A grid electrode 6 and a focusing electrode 7 were arranged between the electron source 5 and the target 12, in an order closer to the electron source 5. The grid electrode 6 is energized through a terminal 10 for the grid electrode, and efficiently draws electrons from the electron source 5. The terminal 10 for the grid electrode was soldered to the insulating member 8, in a similar way to that for the terminal 9 for driving the electron source. The focusing electrode 7 was welded to the cathode 2, and was regulated so as to have the same potential as that of the cathode 2. The focusing electrode 7 reduces a beam diameter of the electron beam which has been drawn by the grid electrode 6, and efficiently irradiates the target 12 with the electron beam.

The cathode 2, the anode 3 and the insulating tube 4 have outer diameters of Φ56 mm, and the focusing electrode 7 has an outer shape approximately of a cylinder and has an outer diameter of Φ25 mm. Each center of the electrodes and the tube is aligned. The insulating tube 4 has a length of 70 mm, and the focusing electrode 7 projects 40 mm from the cathode 2. Accordingly, a projection position of the end of the focusing electrode 7 to the insulating tube 4 is a position 40 mm apart from the cathode 2 along the inner wall of the insulating tube 4. The insulating tube 4 has a wall thickness of 10 mm up to a portion 20 mm apart from the cathode 2, and has a wall thickness of 5 mm in other portions.

Finally, air is exhausted while being heated, from the X-ray tube 1 structured as in the above description through a not-shown exhaust pipe welded to the cathode 2, and the X-ray tube 1 is sealed.

As a comparative example, an X-ray tube was manufactured in a similar way to that in the present example, except that a target 11 having no antistatic member 14 was used.

The X-rays were generated from the above described two X-ray tubes. In the X-ray tube of the comparative example, an insulating surface was exposed, and accordingly the target 11 caused electrostatic charge due to the deposition of electrons which collided with the target 11 or positive ions ionized by the emitted electrons onto the target 11. As a result, the X-ray tube caused electric discharge due to a rise of the electric potential originating from the electrostatic charge, and/or could not stably operate due to the electrostatic charge of the target 11. On the other hand, the X-ray tube of the present example achieved the prevention of the electrostatic charge due to the effect of the antistatic member 14, and could stably operate.

Example 2

An X-ray tube was manufactured in a similar way to that in Example 1, except that a potential-regulating portion 14 of a target 11 was formed by sticking a tungsten material having a film thickness of 20 μm to the substrate, as is illustrated in FIG. 2.

As a result of having generated X-rays in an X-ray tube 1 of the present example, the X-ray tube achieved the prevention of the electrostatic charge due to the effect of the antistatic member 14 and could stably operate, similarly to Example 1. Accordingly, the X-ray tube 1 of the present example achieved the stable operation without causing electric discharge.

Example 3

Figure 3:
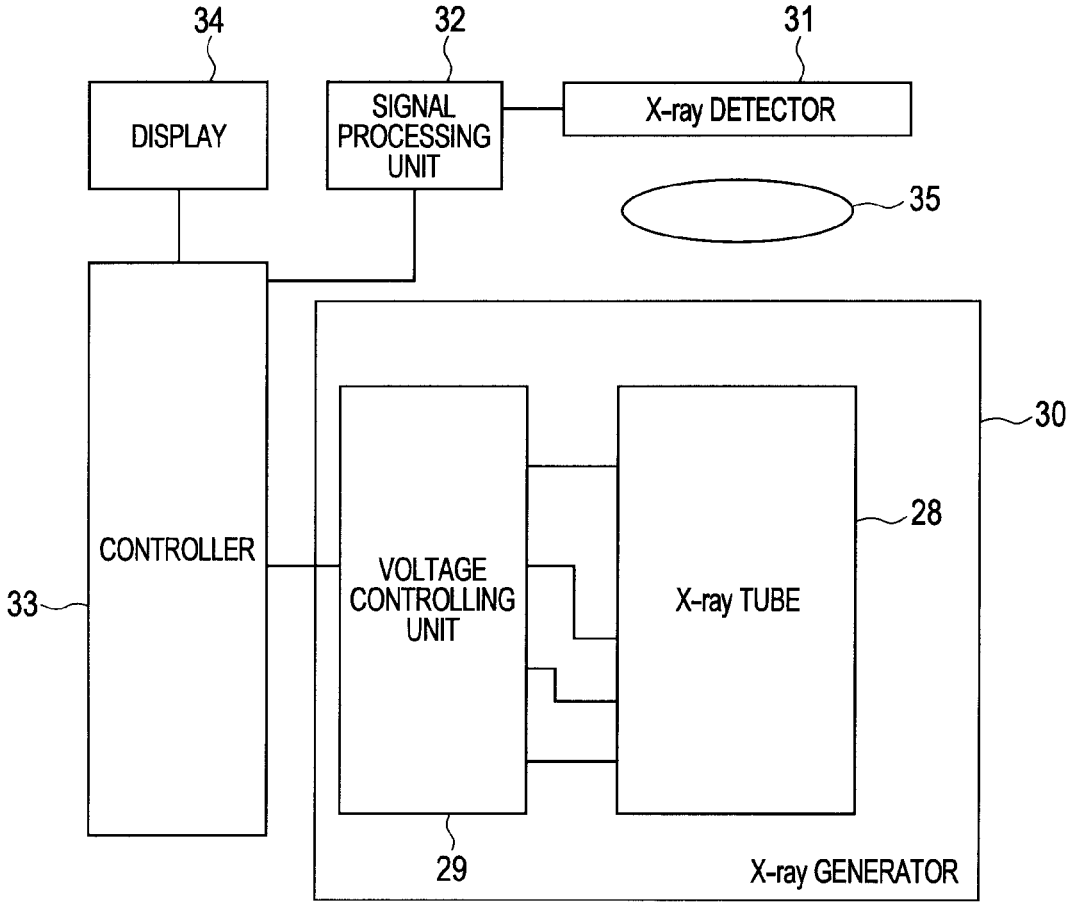
FIG. 3 is a block diagram of an X-ray imaging apparatus using an X-ray tube according to the present invention.

As a result of making X-ray imaging apparatuses illustrated in FIG. 3 take radiographs, which use an X-ray generating apparatus provided with an X-ray tube of Examples 1 and 2, the obtained image solved the turbulence of the image and an unstable operation due to the electrostatic charge of the target, and a clear X-ray image could be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-129843, filed Jun. 10, 2011, which is hereby incorporated by reference herein in its entirety.

What is claimed is:

1. A radiation transmission type target having a target metal placed on a substrate comprising:

an antistatic member placed on a surface of the substrate opposite to a surface on which the target metal is placed.

2. The radiation transmission type target according to claim 1, wherein the substrate is formed from carbon or carbon compound.

3. The radiation transmission type target according to claim 1, wherein the target metal is formed from tungsten, tantalum, platinum, or alloy containing them and rhenium.

4. The radiation transmission type target according to claim 1, wherein the antistatic member is formed from hafnium, tantalum, tungsten, rhenium, osmium, iridium, platinum, gold, titanium, lead, bismuth or alloy of them.

5. A transmission type radiation tube comprising:

an envelope including an insulating tube, a cathode arranged at one side of the insulating tube and an anode arranged at the other side of the insulating tube, wherein an inside of the envelope is hermetically sealed;

an electron source arranged within the envelope; and a target having a target metal being connected electrically to the anode, and generating a radiation responsive to an irradiation with an electron emitted from the electron source, wherein the target is the radiation transmission type target according to claim 1, and the target metal is arranged in opposition to the electron source.

6. A radiation imaging apparatus comprising:

a radiation generating apparatus provided with a transmission type radiation tube according to claim 5; and a radiation detector for detecting a radiation being emitted from the radiation generating apparatus and passing through an object.

* * * * *